US006259031B1

(12) United States Patent
Totland et al.

(10) Patent No.: US 6,259,031 B1
(45) Date of Patent: Jul. 10, 2001

(54) CABLE WITH TWISTING FILLER

(75) Inventors: Rune Totland, Bergen (NO); Timothy N. Berelsman, Delphos, OH (US); Joseph W. Grabowski, Sidney, NE (US)

(73) Assignee: Krone Digital Communications, Englewood, CO (US)

( * ) Notice: Subject to any disclaimer, the term of this patent is extended or adjusted under 35 U.S.C. 154(b) by 0 days.

(21) Appl. No.: 09/370,631

(22) Filed: Aug. 6, 1999

Related U.S. Application Data

(60) Provisional application No. 60/095,818, filed on Aug. 6, 1998.

(51) Int. Cl.[7] ..... H01B 7/00; H01B 11/02

(52) U.S. Cl. ..... 174/110 R; 174/113 R; 174/113 C; 174/116

(58) Field of Search ..... 174/110 R, 113 R, 174/113 G, 36, 27, 116

(56) References Cited

U.S. PATENT DOCUMENTS 2,584,027 * 1/1952 Kendrick ..... 174/108
3,843,829 * 10/1974 Bridge et al. ..... 174/36
3,983,313 * 9/1976 Ney et al. ..... 174/121 SR
5,110,999 * 5/1992 Barbera ..... 174/36
5,789,711 * 8/1998 Gaeris et al. ..... 174/113 C
5,883,334 * 3/1999 Newmoyer et al. ..... 174/113 R
5,952,615 * 9/1999 Prudhon ..... 174/113 C

* cited by examiner

*Primary Examiner*—Dean A. Reichard
*Assistant Examiner*—William H. Mayo, III
(74) *Attorney, Agent, or Firm*—Rader, Fishman & Grauer PLLC

(57) ABSTRACT

A cable includes an even number of pairs of conductors divided into an even number of groups and a single pair of conductors that encircle a length of filler material. The even number of groups conductors surround the single pair of conductors and the filler material. In one embodiment, the filler material is twined to cause an air gap to surround any portion of the groups that are not in contact with the filler material. In another embodiment, a longitudinal groove is formed on the outer surface of the filler material and the single pair of conductors rides on the groove. An outer shield surrounds all the pairs of conductors and the filler material. A method of forming the cable is disclosed.

25 Claims, 3 Drawing Sheets

CABLE WITH TWISTING FILLER

This application is a continuation of provisional application No. 60/095.818, filed Aug. 6, 1998.

TECHNICAL FIELD OF THE INVENTION

The present invention relates to cables, and more particularly to cables comprising an odd number of conductor pairs.

BACKGROUND OF THE INVENTION

Various telecommunication systems require communication cables comprising an odd number of conductor pairs. A commonly used cable for such purposes is the twenty-five pair, category five cable. This cable, like other cables, must comply with associated TIA/EIA requirements. Various cable construction techniques have been tried by cable manufacturers in an attempt to pass the power sum near-end crosstalk (NEXT) specification for TIA/EIA twenty-five pair category five cables.

For a plenum product, the use of a filler having a star configuration would not allow the product to pass the UL 910 burn test. This is so because the star filler greatly increases the percentage of combustible plastics when compared to a copper heat sink based upon presently known state of the art materials.

The layout of the pairs of conductors comprising a cable is critical in the cable passing the TIA/EIA power sum NEXT electrical specification. One of the more successful attempts utilized a cable construction having the twenty-fifth pair jacketed and used as a center filler with six quads using two or more different pair lay schemes and one or more different quad lay lengths (L) surrounding the filler. However, the location of the twenty-fifth pair inside the filler causes increased installation times and potential for damage. For example, in cables utilizing such a cable layout, the twenty-fifth pair is prone to damage when stripping off the end of the rather thick filler jacket during installation.

Several different cable constructions have been attempted in the past, including having the twenty-fifth pair pulled straight in between two of the quads, having the twenty-fifth pair placed by the center along with the tube filler, and laying the twenty-fifth pair on the outside of the cable core. However, the cables fail to meet the TIA/EIA power sum NEXT requirements for the twenty-fifth pair. In addition, the cables also failed signal reflection loss (SRL), impedance, and attenuation requirements due to instability in the twenty-fifth pair.

It was also found that the twenty-fifth pair interfered with the pairs in the quads closest to it. The damage to the insulation of the twenty-fifth pair was caused by the twenty-fifth pair being pinched between quads, or being pinched between the quads and the filler, or being pinched between the core and the jacket.

A cable construction involving jacketing twelve and thirteen pairs of conductors together to yield a twenty-five pair cable has also been attempted with limited success. For example, the resulting shape of the cable is not round, thus making it harder to install, specifically with regard to conduit fill.

SUMMARY OF THE INVENTION

The present invention is directed to a cable, which includes an even number of paired conductors, along with an additional couple of conductors. Thus, the total number of paired conductors is an odd number. The even number of paired conductors are evenly divided into groups of at least two conductor pairs. The additional pair of conductors is paired with, and encircles a filler material along its length. The groups of conductor pairs and the additional pair that is coupled with the filler material extend in parallel to form the cable so the groups of conductor pairs surround the additional pair and the filler material. A jacket material surrounds the conductor pairs and the filler material.

In one embodiment of the invention, the filler material has a larger diameter than the additional pair of conductors, and the filler material is twined with the additional pair of conductors, so that the filler material causes an air gap to surround any portion of the additional pair of conductors that is not in contact with the filler material. In another embodiment of the invention, the filler material secures the additional pair of conductors within a longitudinal groove formed in the filler material.

In a preferred embodiment of the invention, the filler material has a dielectric constant higher than a dielectric constant of air. More particularly, the filler material is selected from at least one of the following: polyfluoroalkoxy, TFE/Perfluoromethyl-vinylether, ethylene chlorotrifluoroethylene, polyvinyl chloride, fluorinated perfluoroethylene polypropylene and flame retardant polypropylene.

Also in a preferred embodiment of the invention, the jacket material includes a dielectric layer. The dielectric layer can be a single or a multiple dielectric layer, with each layer comprising at least one of the following: low smoke zero halogen, polyvinyl chloride, flame retardant polyethylene, linear low density polyethylene, polyvinylidene fluoride, ethylene chlorotrifluoroethylene, fluorinated ethylene-propylene, thermoplastic elastomer, and polyurethane.

Each conductor can be a bare copper wire, and each should be insulated with an insulating material having a dielectric constant no greater than about 2.5. Normally, each bare copper wire is between 22 AWG and 24 AWG. The insulating material preferably includes at least one of the following: flame retardant polyethylene, flame retardant polypropylene, high density polyethylene, polypropylene, polyfluoroalkoxy, solid or foamed TFE/perfluoromethylvinylether, solid or foamed fluorinated ethylene-propylene, and foamed ethylene chlorotrifluoroethylene.

The present invention is also directed to a method for manufacturing the above-described cable. First, the couples of conductors are paired with each other to make an even number of pairs. Then, the additional couple of conductors are paired, making the total number of paired conductors an odd number. The even number of paired conductors are then evenly divided into groups of at least two conductor pairs. The additional pair of conductors are coupled with, and encircled around the filler material along its length, and the groups of conductor pairs, and the additional pair coupled with the filler material are extended in parallel to form a cable so the groups of conductor pairs surround the additional pair of conductors and the filler material. Finally, the cable is surrounded by a jacket material.

DETAILED DESCRIPTION OF THE PREFERRED EMBODIMENT

Figure 1:
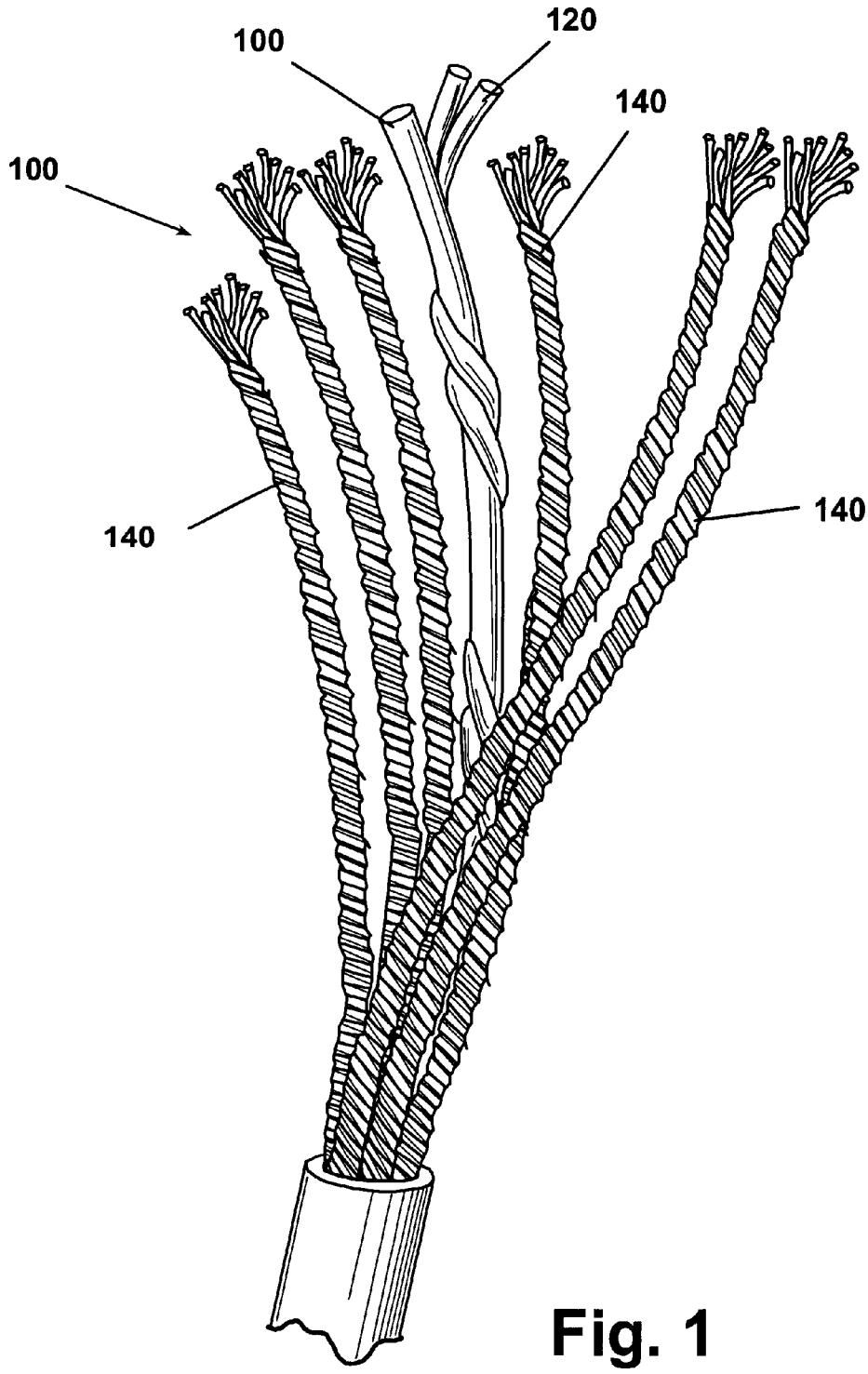
FIG. 1 shows a perspective view of a cable according to a first embodiment of the invention, where the odd pair of conductors is wrapped around a filler material of low flexibility.

In a first embodiment of the invention, a cable, 100 in FIG. 1 has twenty-five pairs of wires. First, six quads 140 of four wires each are separately formed. Then the twenty-fifth pair of wire 120 is wrapped around a filler 110 in a manufacturing step while, or before cabling the filler 110 and the twenty-fifth pair 120 with the other six quads 140. The filler 110 is made of a high flame retardant material with a dielectric constant lower than 3.2 to avoid SRL failures due to signal reflections between layers of unlike dielectric constants. Care is taken in choosing the material of the filler 110 such that the electromagnetic fields propagating down the wire are attenuated to the slightest degree possible, and at the same time pair to pair coupling fields are attenuated to the highest degree possible. Acceptable materials include, for example, polyfluoroalkoxy (PFA), TFE/Perfluoromethylvinylether (MFA), ethylene chlorotrifluoroethylene (ECTFE), polyvinyl chloride (PVC), fluorinated perfluoroethylene polypropylene (FEP) and flame retardant polypropylene (FRPP).

Figure 3:
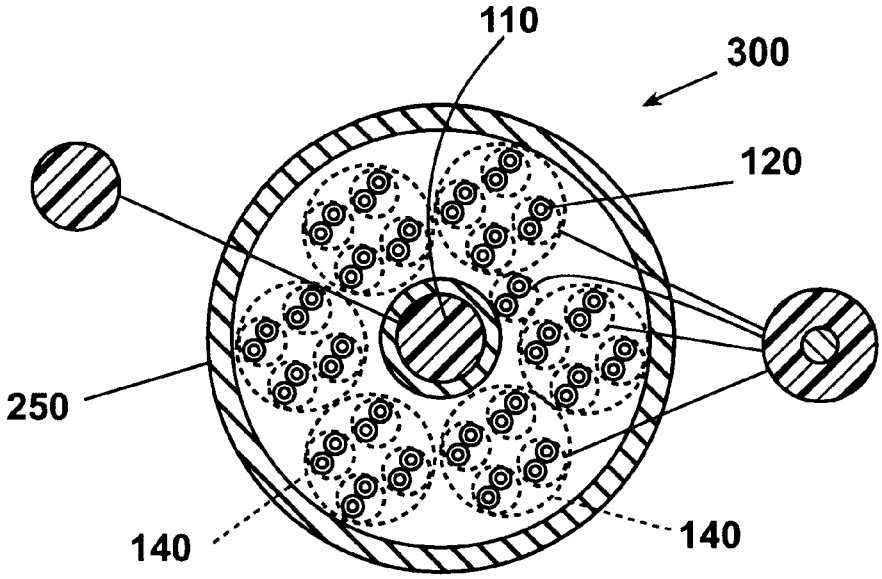
FIG. 3 shows a cross sectional view of a cable according to the first or second embodiment of the invention.
Figure 5:
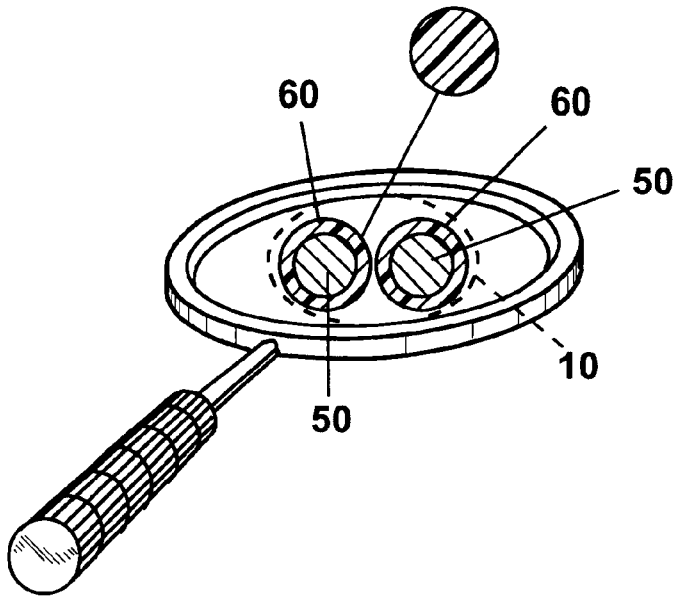
FIG. 5 shows a single pair of conductors.

According to the first embodiment, the cable 100 of the invention comprises bare copper conductors 50 between 22 AWG and 24 AWG. Each conductor 50 is insulated with a material 60 having a dielectric constant of about 2.5 or less, including flame retardant polyethylene (FRPE), flame retardant polypropylene (FRPP), high density polyethylene (HDPE), polypropylene (PP), MFA, PFA or FEP in solid or foamed form, and foamed ECTFE. The conductors 50 are twined to form pairs 10 as shown in FIG. 5, and then assembled as shown in FIG. 3. The dotted lines in FIG. 3 are used to show groupings of conductor pairs 10, and quads 140 that consist of braided conductor pairs 10, but do not designate a material.

At the same time, each of the groups of at least two conductor pairs can be surrounded by a material. As an example, each group 140 may be surrounded by a group shield that is manufactured to include an aluminum/polyester material, an aluminum/polypropylene material, and/or a tinned or aluminum braid.

According to the principles of the invention, each of the groups 140 demonstrates a worst pair near end crosstalk within the group of 35 db at 100 mHz for data transmission, in accordance with TIA/EIA minimum requirements. Furthermore, a near end crosstalk isolation between the groups 140 demonstrates a worst case performance of 38 db power sum at 100 mHz in accordance with TIA/EIA minimum requirements. An overall jacket 250 comprises a single dielectric layer or multiple dielectric layer, including layers comprising any of the following materials: low smoke zero halogen (LSOH), polyvinyl chloride (PVC), flame retardant polyethylene (FRPE), linear low density polyethylene (LLDPE), polyvinylidene fluoride (PVDF), ethylene chlorotrifluoroethylene (ECTFE), fluorinated ethylene-propylene (FEP), thermoplastic elastomer (TPE) or polyurethane. There also may be an outer shield placed around all of the paired conductors that may include, alone or in combination with other materials, an aluminum/polyester material, an aluminum/ polypropylenematerial, and/or a tinned braid or aluminum braid.

The exact combinations of materials are selected based on the environmental characteristics (indoor, outdoor, chemical plant, high humidity, temperature extremes, etc.) and overall flame retardant characteristics (nonplenum general horizontal cabling, riser, plenum, none, etc.) that a given cable is required to meet for a given installation.

Figure 2:
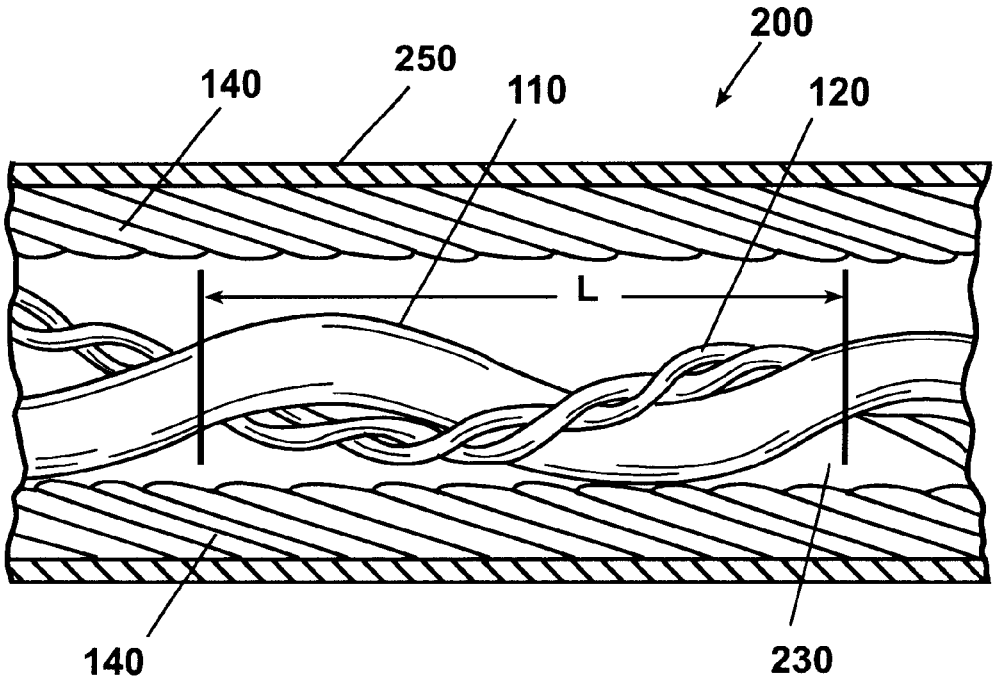
FIG. 2 shows a longitudinal cutaway view of a cable according to a second embodiment of the invention, where the odd pair of conductors is twined with a flexible filler material.

In a second embodiment of the invention the filler 110 is also flexible enough to twine with the twenty-fifth pair 120 as shown in FIG. 2, rather than having the twenty-fifth pair 120 wrap around the filler 110 as shown in the first embodiment of FIG. 1. When the twenty-fifth pair 120 is twisted with filler 110, the filler exhibits a varying central axis resulting in a wavy shape. The wavy shape protects the twenty-fifth pair 120 from being pinched between the surrounding quads 140 and filler 110 as shown in FIGS. 2 and 3. This is especially true when the filler material 110 has a diameter greater than the width of the pair of conductors 120.

Furthermore, as shown in FIG. 2, the varying central axis provides an air pocket 230 along the center of the cable core. The air pocket 230 enhances the dielectric constant surrounding the twenty-fifth pair 120, and maximizes separation and provides a dielectrically enhanced border to the six other quads 140 in the construction.

One of the important effects of twining the twenty-fifth pair 120 with the filler 110 prior to or while cabling it with the six other quads 140 is that the position of the twenty-fifth pair 120 is altered compared to the other six quads 140 such that the twenty-fifth pair 120 will only be close to one quad 140 once every repetition of the lay length (L) of the twenty-fifth pair 120 twined with the filler 110. The electromagnetic coupling between pairs 10 is evenly distributed with reference to the twenty-fifth pair 120 in the above-described construction. As a result, the cross-talk is minimized in the resulting cable.

Furthermore, twining the twenty-fifth pair 120 with the centrally located filler 110, with the evenly divided conductor pairs 140 surrounding the filler and the twenty-fifth pair, ensures that the cable construction stays the same during installation, resulting in a round cable. This is especially important during cable installation. When installing the cable in conduits, cable trays and over J hooks, for example, the cable is forced around corners and is subject to various strains. The round shape of the cable makes it easier to install, and twisting the twenty-fifth pair 120 with the filler 110 ensures that it stays in place even when the cable is forced around bends during installation.

Having the first twenty-four pairs cabled into four pair quads 140 in a manufacturing step prior to or while cabling all six of the quads 140 and the filler 110 with the twenty-fifth pair 120 into the cable core, causes the positions of the individual pairs 10 in the quads 140 in reference to the outside of the core to be altered at the frequency of the quad lay lengths (L). Such a construction minimizes capacitive coupling between pairs in a first cable with pairs having the same lay lengths (L) in adjacent cables installed next to the first cable or around it in, for example, a cable tray. In turn, crosstalk between adjacent installed cables is minimized.

Figure 4:
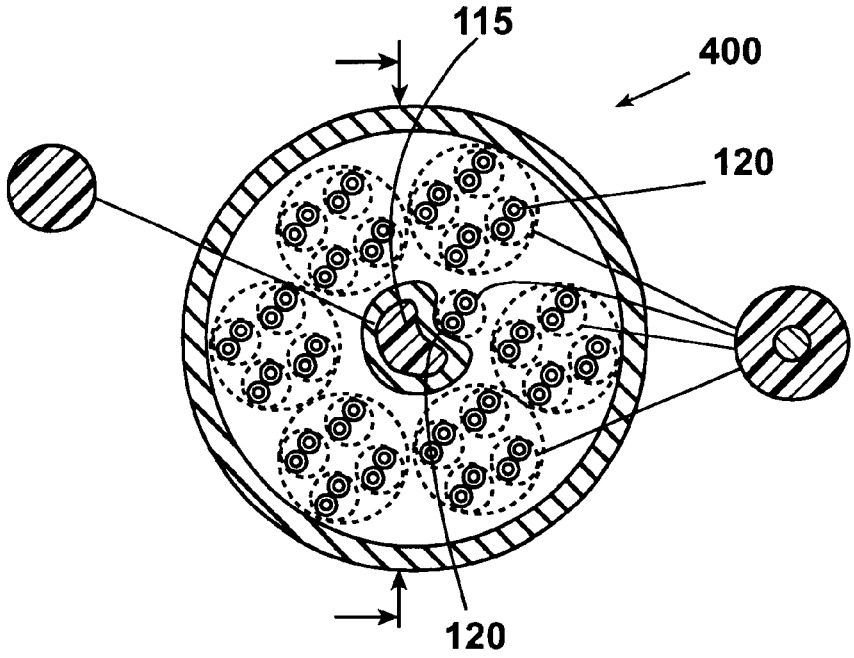
FIG. 4 shows a cross sectional view of a cable according to a third embodiment of the invention, where the filler material includes a longitudinal groove.

In a third embodiment of the cable, the physical protection and dielectric effect of the twenty-fifth pair 120 are further enhanced by making a filler 115 with a longitudinal groove, deep and wide enough to let the twenty-fifth pair 120 ride in it. FIG. 4 shows the cross-sectional view of cable 400, made according the third embodiment. As shown in FIG. 4, filler 115 has a groove 410 within which twenty-fifth pair 120 rides.

Although the above described construction of cable 400 compromises to some extent the resulting cable's attenuation performance, it also enhances the cable's NEXT performance. Cable 400 displays an increase in attenuation in comparison to the attenuation of cable 300 (shown in FIG. 3) because in the construction of cable 400, twenty-fifth pair 120 is partially encompassed by the material comprising filler 115. The material of filler 115 has a much higher dielectric constant than air (which primarily surrounds twenty-fifth pair 120 of cable 300). As a result, the attenuation loss is higher in cable 400. Accordingly, because cable 400 is partially encompassed by the material comprising filler 115, it has minimal crosstalk in comparison with cable 300.

It will be understood that the foregoing is only illustrative of the principles of this invention and that various modifications can be made by those skilled in the art without departing from the scope and spirit of the invention. For example, cables according to the present invention may include a thirteen pair construction having three quads with the thirteenth pair twisted with the filler. Similarly, a fifty pair cable could also be constructed in accordance with the present invention by having two twenty-five pair units constructed and then installed within a single jacket. The fifty pair cable described above could also be constructed by having two twenty-five pair units each split into sub-units of three quads (twelve pairs) and three quads, respectively, with a single pair twisted with the filler (thirteen pairs).

What is claimed is:

1. A cable, comprising:

a single pair of conductors encircling a length of filler material;

a plurality of quads surrounding said single pair of conductors and said filler material, each quad containing four pairs of conductors; and an outer shield surrounding said single pair of conductors, said filler material, and plurality of quads.

2. The cable of claim 1, wherein said plurality of quads comprises six quads.

3. The cable of claim 1, wherein said filler material is twined with said single pair of conductors forming an air gap between any portion of any said plurality of quads that are not in contact with said filler material.

4. The cable of claim 1, further including a longitudinal groove formed in an outer surface of said filler material, said single pair of conductors riding within said groove.

5. The cable of claim 1, wherein said filler material has a larger diameter that a width of said single pair of conductors.

6. The cable of claim 1, wherein said filler material has a dielectric constant higher than a dielectric constant of air.

7. The cable of claim 6, wherein said filler material consists essentially of one of polyfluoroalkoxy, TFE/Perfluoromethylvinylether, ethylene chlorotrifluoroethylene, polyvinyl chloride, fluorinated perfluoroethylene polypropylene, flame retardant polyethylene, and flame retardant polypropylene.

8. The cable of claim 1, wherein said single pair of conductors comprises bare copper wire individually insulated with an insulating material having a dielectric constant no greater than about 2.5.

9. The cable of claim 8, wherein said insulating material consists essentially of one of flame retardant polyethylene, flame retardant polypropylene, high density polyethylene, polypropylene, polyfluoroalkoxy, solid or foamed TFE/perfluoromethylvinylether, solid or foamed fluorinated ethylene-propylene, and foamed ethylene chlorotrifluoroethylene.

10. The cable of claim 1, wherein said outer shield consists essentially of one of aluminum/polyester, aluminum/polypropylene, and tinned or aluminum braid.

11. A cable, comprising:

an odd number of conductor pairs, comprising:

a single conductor pair encircling a filler material; and an even number of conductor pairs forming an even number of groups surrounding said single pair of conductors and said filler material; and an outer shield surrounding said odd number conductor pairs.

12. The cable of claim 11, wherein said even number of groups comprises six groups.

13. The cable of claim 11, wherein said filler material is twined with said single conductor pair forming a gap between any portion of any said even number of groups that are not in contact with said filler material.

14. The cable of claim 11, further including a groove formed in an outer surface of said filler material, said single conductor pair riding on said groove.

15. The cable of claim 11, wherein said filler material has a larger diameter that a width of said single conductor pair.

16. The cable of claim 11, wherein said filler material has a dielectric constant higher than a dielectric constant of air.

17. The cable of claim 11, wherein said filler material consists essentially of one of polyfluoroalkoxy, TFE/Perfluoromethylvinylether, ethylene chlorotrifluoroethylene, polyvinyl chloride, fluorinated perfluoroethylene polypropylene, flame retardant polyethylene, and flame retardant polypropylene.

18. The cable of claim 11, wherein said single conductor pair comprises bare copper wire individually insulated with an insulating material having a dielectric constant no greater than about 2.5.

19. The cable of claim 18, wherein said insulating material consists essentially of one of flame retardant polyethylene, flame retardant polypropylene, high density polyethylene, polypropylene, polyfluoroalkoxy, solid or foamed TFE/perfluoromethylvinylether, solid or foamed fluorinated ethylene-propylene, and foamed ethylene chlorotrifluoroethylene.

20. The cable of claim 11, wherein said outer shield consists essentially of one of aluminum/polyester, aluminum/polypropylene, and tinned or aluminum braid.

21. A cable, comprising twenty-five pairs of conductors, wherein a single pair of conductors of said twenty-five pairs of conductors encircles a filler material, and a remaining twenty-four pairs of conductors of the twenty-five pairs of conductors are formed in an even number of groups which surround the filler material and the single pair of conductors; and an outer shield surrounding said twenty-five pairs of conductors.

22. The cable of claim 21, wherein said even number of groups comprises six groups, each group containing four pairs of conductors.

23. The cable of claim 21, wherein said filler material is twined with said single pair of conductors forming a gap between any portion of any said even number of groups that are not in contact with said filler material.

24. The cable of claim 21, further including a longitudinal groove formed in an outer surface of said filler material, said single pair of conductors riding within said groove.

25. A method for manufacturing a cable, comprising the steps of:

encircling a length of filler material with a single conductor pair;

surrounding said filler material and said single conductor pair with an even number of groups, each group containing an even number of conductor pairs; and surrounding said single conductor pair, said filler material, and said even number of groups with an outer shield.

* * * * *